US005408930A

United States Patent [19]

Loos

[11] Patent Number: 5,408,930

[45] Date of Patent: Apr. 25, 1995

[54] DEVICE FOR SELECTIVELY CLEANING A PLURALITY OF CYLINDERS

[75] Inventor: Gerhard Loos, Horrenberg, Germany

[73] Assignee: Heidelberger Druckmaschinen, Heidelberg, Germany

[21] Appl. No.: 36,813

[22] Filed: Mar. 25, 1993

[30] Foreign Application Priority Data

Mar. 25, 1992 [DE] Germany ..... 42 09 642.1

[51] Int. Cl.[6] ..... B41F 35/00

[52] U.S. Cl. ..... 101/423; 101/425

[58] Field of Search ..... 101/423, 424, 425, 165-168

[56] References Cited

U.S. PATENT DOCUMENTS

| | | | |
|---|---|---|---|
| 4,270,450 | 6/1981 | Difflipp et al. | 101/142 |
| 4,920,880 | 5/1990 | Hara et al. | 101/423 |
| 4,981,078 | 1/1991 | Dettinger et al. | 101/425 |
| 5,105,740 | 4/1992 | Loos et al. | 101/424 |
| 5,150,653 | 9/1992 | Hara . | |

FOREIGN PATENT DOCUMENTS

| | | | |
|---|---|---|---|
| 334173 | 9/1989 | European Pat. Off. . | |
| 1960728 | 5/1967 | Germany . | |
| 2815388 | 6/1981 | Germany . | |
| 3744800 | 6/1989 | Germany . | |
| 3917081 | 1/1990 | Germany . | |
| 0114748 | 5/1991 | Japan | 101/423 |
| 1149396 | 8/1965 | United Kingdom . | |

*Primary Examiner*—Edgar S. Burr
*Assistant Examiner*—Anthony H. Nguyen
*Attorney, Agent, or Firm*—Herbert L. Lerner; Laurence A. Greenberg

[57] ABSTRACT

Device for selectively cleaning a plurality of cylinders of a sheet-fed printing press includes a washing device having equipment forming a cleaning surface, and a mutual pressure device for selectively bringing the cleaning surface into contact with one of the cylinders along a line of contact of the cleaning surface and the one cylinder extending parallel to a longitudinal axis of the one cylinder, and drive device for moving the cleaning surface so as to vary the position of the contact line with respect to the cleaning surface.

10 Claims, 11 Drawing Sheets

Fig.11a
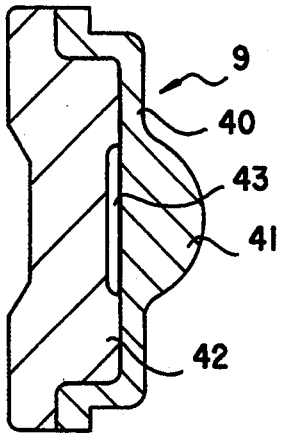
Fig.11b
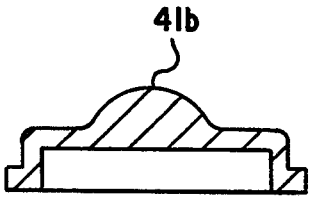
Fig.11c
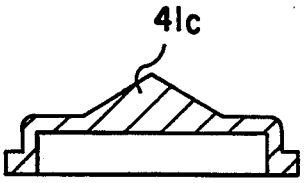
Fig.11d
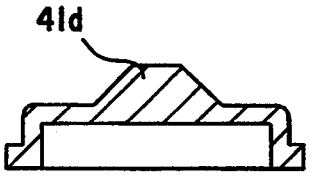
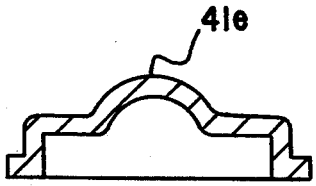
Fig.11e
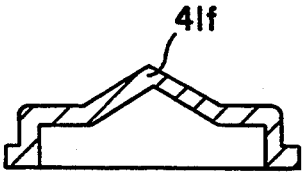
Fig.11f
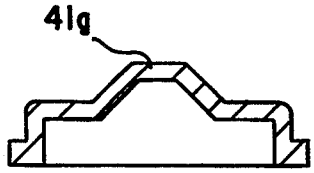
Fig.11g

DEVICE FOR SELECTIVELY CLEANING A PLURALITY OF CYLINDERS

SPECIFICATION

The invention relates to a device for selectively cleaning a plurality of cylinders of a sheet-fed printing press.

A device for washing a plurality of cylinders of a sheet-fed printing press has become known heretofore from German Patent Publication DE 28 15 388 C3, wherein a washing roller mounted on a lever can be brought selectively into cleaning contact with a blanket cylinder or with an impression cylinder by pivoting the lever. In this regard, two separate drive mechanisms are provided for cleaning the two cylinders. When the washing roller is pivoted away from the one cylinder, first the one pressure connection is broken, and when the washing roller is pivoted towards the other cylinder, the second pressure connection is made. The use of two pressure mechanisms requires the provision of two complete and independent drive systems. The outlay of material and the expenditure for manufacture, assembly and maintenance is undesirably high for such a device upon which demands for high quality are made.

A washing device for cleaning a plurality of cylinders has become known heretofore from European Patent Document EP 0 334 173 A1, in which a cleaning cloth is brought, with the aid of several pressure elements, into contact with the cylinder to be cleaned. In this washing device, a separate pressure element is provided for each cylinder to be cleaned. By means of costly and complex control of the cloth feed as well as of the pressure elements, an effort is made to prevent the piece of cloth which was soiled by cleaning one cylinder from being used to clean the next cylinder. Doubling of the pressure elements requires additional expenses in material and manufacturing costs. Assembly and control of the pressure elements are expensive. Such a device also requires that the space between the cylinders be increased and permanently taken up by the device.

A washing device for a rubber blanket has become known heretofore from German Patent Publication DE 37 44 800 A1, in which a cleaning cloth is disposed in cleaning contact with the blanket cylinder with the aid of a pressing brush. The wiping cloth and the pressing brush are disposed in a pivotable frame. After completion of the cleaning process, the wiping cloth and the pressing brush are removed from the cleaning position by slightly pivoting the pivot frame. The pivot frame together with the wiping cloth and the pressing brush is pivoted back into the cleaning position prior to a renewed performance of the washing process.

It is an object of the invention of the instant application to provide a washing device for selectively cleaning a plurality of cylinders of a printing press simply and with minimized expense.

With the foregoing and other objects in view, there is provided, in accordance with the invention, a device for selectively cleaning a plurality of cylinders of a sheet-fed printing press, comprising a washing device having means forming a cleaning surface, and mutual pressure means for selectively bringing the cleaning surface into contact with one of the cylinders along a line of contact of the cleaning surface and the one cylinder extending parallel to a longitudinal axis of the one cylinder, and drive means for moving the cleaning surface so as to vary the position of the contact line with respect to the cleaning surface.

A minimization of material, production effort, maintenance effort and assembly effort is possible by thus using only one common pressure means and only one common drive means for moving or feeding the cleaning surface for cleaning several cylinders. Minimizing the means required for cleaning each cylinder to a single unit also affords a space-saving integration of the device into the printing press.

In accordance with another feature of the invention, the contact line is common to the cleaning surface and to each of a plurality of the cylinders and is pivotable from cylinder to cylinder.

A reduction in the means which are used, as well as of manufacturing and adjustment expenditures for effecting the contact, is thereby afforded. In addition, due to the pivotable construction, the control outlay for moving or feeding the cloth during the cleaning of several cylinders is minimized, while optimal cleaning quality is maintained.

In accordance with a further feature of the invention, the means forming the cleaning surface comprise a cleaning cloth, and further included are a clean-cloth winding roller and a soiled-cloth winding roller, the cleaning cloth having one end thereof rolled onto the clean-cloth winding roller and the other end thereof rolled onto a soiled-cloth winding roller, common support means for supporting the clean-cloth and the soiled-cloth winding rollers and the mutual pressure means in common, guide means pivotally mounted in side frames of the printing press, the common support means being insertable into the guide means, and means provided on the side frames of the printing press for pivoting the guide means.

This construction affords optimal cleaning of the cylinders, while making the cylinders readily accessible. The means for pivoting the cylinders can be provided entirely in the vicinity of the side frames of the printing press. Thus, because neither air hoses nor other pivot elements are required on the insertable device for selective cleaning of several cylinders, it is possible to construct the device quite simply and in a cost-effective manner, while retaining the advantages of sliding the washing device in and out, respectively. At the same time, the space between the two side frames of the press can be kept clear of additional elements and available for the pivoting which requires considerable space.

In accordance with an added feature of the invention, the printing press has side frames, and the drive means for moving the cleaning surface are provided in the side frames of the printing press.

This affords a particularly simple construction and arrangement of all drive means for such a device in a sheet-fed printing press. Additional protective measures and measures for making space available for the drive means between the side frames of the press can be dispensed with.

In accordance with an additional feature of the invention, means for moistening the cleaning cloth are disposed in the side frames of the printing press in vicinity of the one cylinder.

Thus, a particularly simple arrangement of the means for moistening the cleaning cloth is provided. Due to the single fixed arrangement on the printing press of the device for the selective cleaning of several cylinders of a sheet-fed printing press, the expense necessary for supply lines and tanks or receptacles for reliably moistening a jointly-pivoted arrangement can be eliminated.

In accordance with yet another feature of the invention, the means for pivoting the guide means comprise a common shaft journalled in the side frames of the printing press for introducing a force for pivoting the pivotally mounted guide means as well as for activating the drive means for moving the cleaning surface.

In accordance with yet a further feature of the invention, common shaft means are journalled in the side frames of the printing press for introducing a force and for simultaneously serving as a pivot shaft of the device.

In accordance with yet an added feature of the invention, further included are means for arresting the washing device in a working position of the cleaning device wherein the guide means form an insert opening wherein the washing device is received, means for forming, in the working position, a driving connection between the drive means for moving the cleaning surface and the soiled-cloth winding roll, and means for disabling the arresting means for removing the washing device from the working position and simultaneously breaking the driving connection between the cleaning-surface drive means and the soiled-cloth winding roll.

The last three features of the invention afford particularly advantageous, simple and space-saving constructions of the pivoting and cloth moving or feeding mechanisms.

In accordance with an additional feature of the invention, one of the cylinders to be cleaned is a rubber blanket cylinder and another of the cylinders is an impression cylinder, and a sheet guiding device is disposed on the common support means in vicinity of the impression cylinder.

It is thereby furthermore possible, by relatively simple means, to combine reliable sheet feeding in the vicinity of the impression cylinder with relative easy access to the cylinders in a sheet-fed printing press.

In accordance with a concomitant feature of the invention, the means forming the cleaning surface are a cleaning cloth, and further included are a clean-cloth winding roller and a soiled-cloth winding roller, the cleaning cloth having one end thereof rolled onto the clean-cloth winding roller and the other end thereof rolled onto a soiled-cloth winding roller, and means for supporting the clean-cloth and the soiled-cloth winding rollers and the mutual pressure means, the drive means for moving the cleaning surface comprising means for feeding the cleaning cloth over the mutual pressure means from the clean-cloth winding roller to the soiled-cloth winding roller.

Other features which are considered as characteristic for the invention are set forth in the appended claims.

Although the invention is illustrated and described herein as embodied in a device for selectively cleaning a plurality of cylinders, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which.

FIGS. 11*a* to 11*g* are respective cross-sectional views of different embodiments of a pressure element forming part of the washing device according to the invention.

Figure 1:
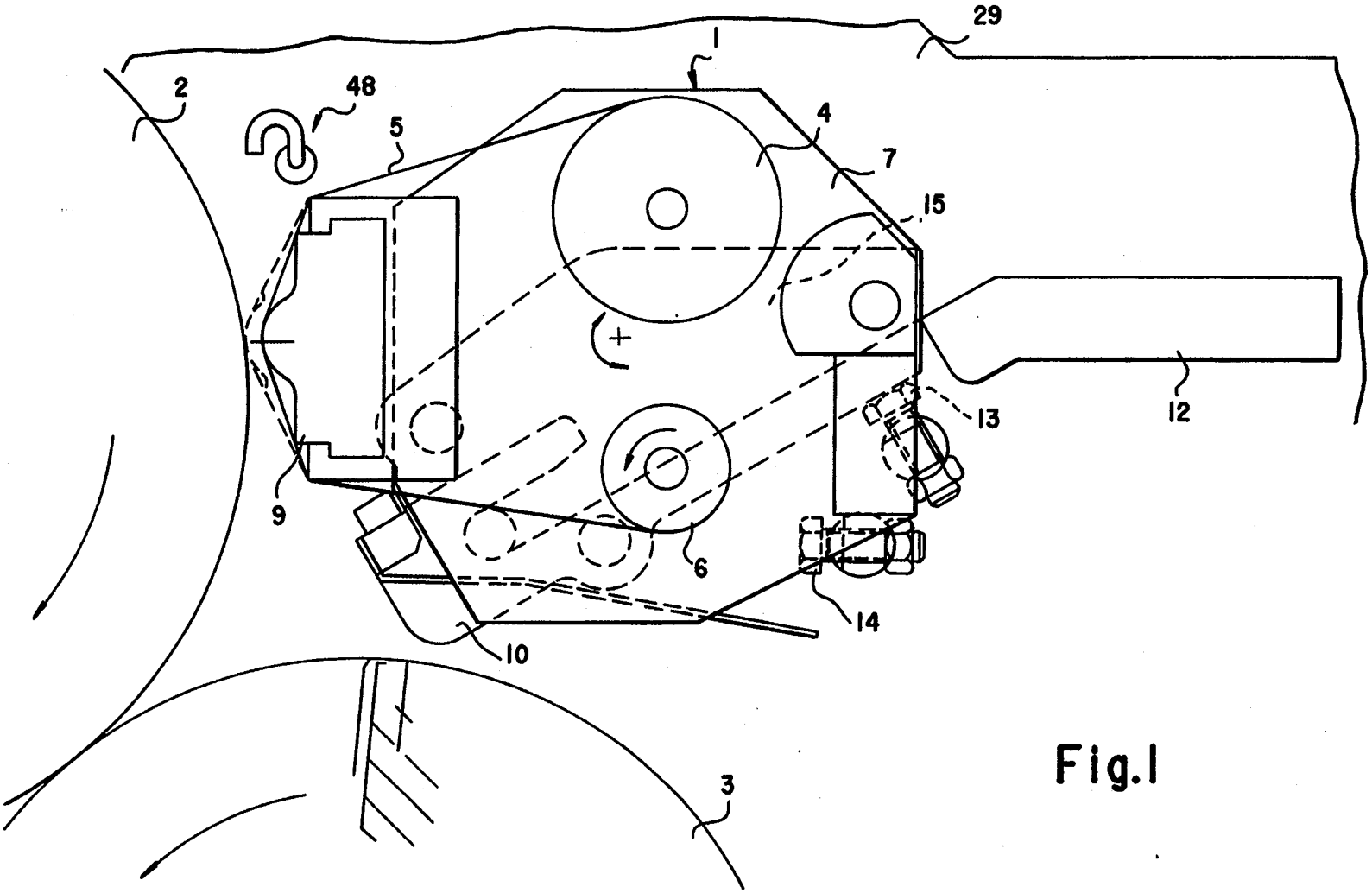
FIG. 1 is a side elevational view of a washing device according to the invention disposed in a rubber-blanket washing position in a sheet-fed printing press.
Figure 2:
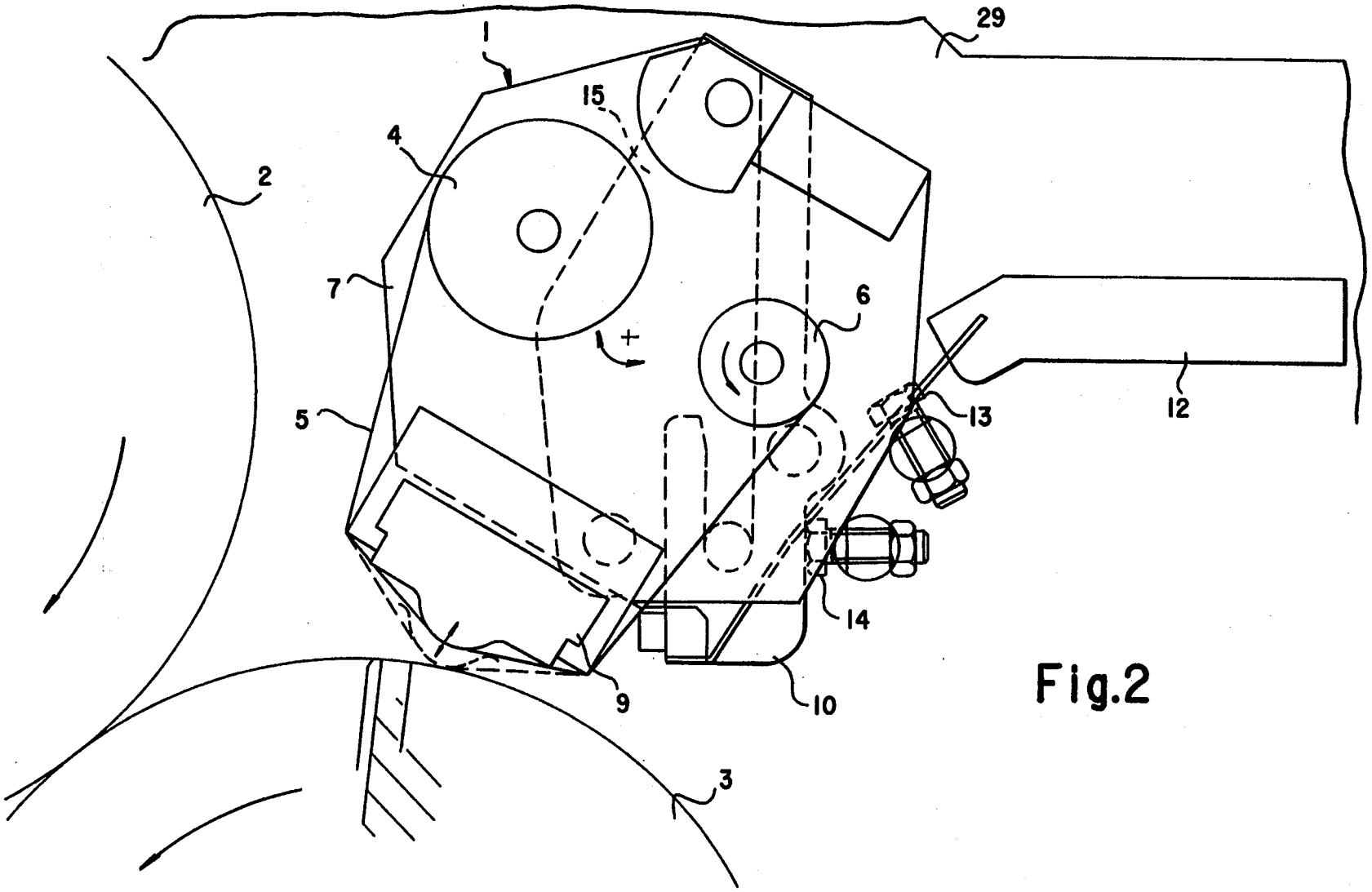
FIG. 2 is a view like that of FIG. 1 showing the washing device in another operating phase thereof, namely, in an impression-cylinder washing position.

Referring now to the drawings and, first, particularly to FIGS. 1 and 2 thereof, there is shown therein, disposed between side frames 29 and 30 of the printing press, of which only the side frame 29 is shown in FIGS. 1 and 2, a washing device 1 for cleaning, respectively, a rubber blanket cylinder 2 and an impression cylinder 3 of a sheet-fed rotary printing press. The washing device 1 is formed of two support or bearing plates 7 facing the side frames 29 and 30 of the press, only one of the support plates 7 being shown in the figures, a clean-cloth winding roller 4 and a soiled-cloth winding roller 6 rotatably mounted or journalled in the support plates 7 parallel to the cylinders 2 and 3, a cleaning cloth 5 stretched between the clean-cloth winding roller 4 and the soiled-cloth winding roller 6, and a pressure element 9. The cleaning cloth 5 is guided over the pressure element 9 which, as shown in FIG. 11*a*, is formed of a membrane or diaphragm 40 stretched over a sealing body 42. A pressure chamber 43 is provided in the sealing body 42 and is connected to a non-illustrated compressed air supply via a non-illustrated connection. When the compressed air supply is actuated to supply air through the aforementioned connection to the pressure chamber 43, a spherical central region 41 of the pressure membrane 40 is pressed outwardly from the pressure chamber 43. The cleaning cloth 5, as represented in FIGS. 1 and 2 by broken lines, is accordingly pressed against the respective cylinder 2 or 3, which is to be cleaned. After the compressed air supply is shut off, the pressure membrane or diaphragm 40 relaxes and the cleaning cloth 5 is returned, in a conventional manner, to the starting position thereof, shown in solid lines.

Figure 3:
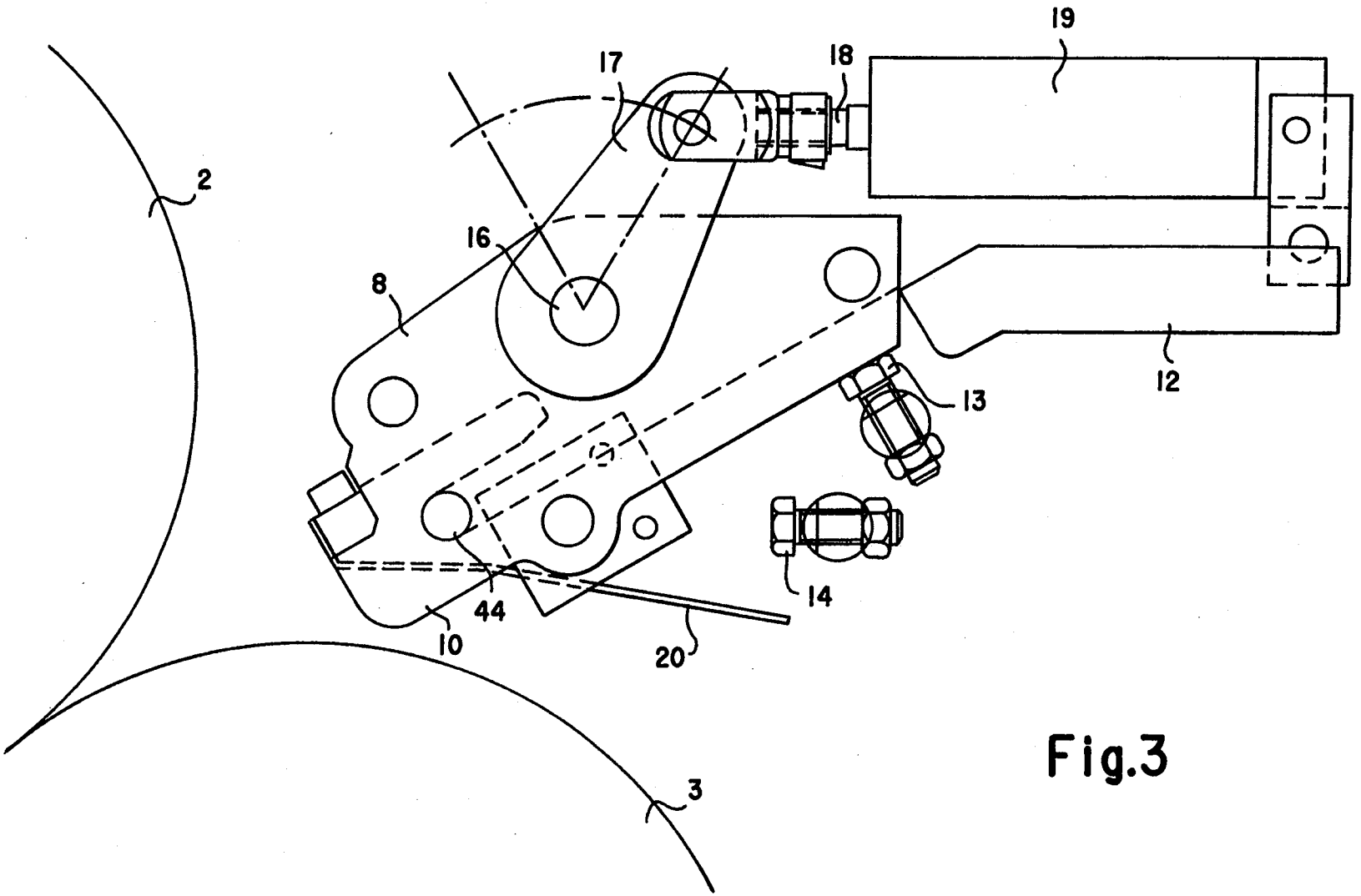
FIG. 3 is a view like that of FIG. 1 with part of the washing device omitted so as to show more clearly the pivot drive thereof in the position for washing the rubber blanket cylinder.
Figure 4:
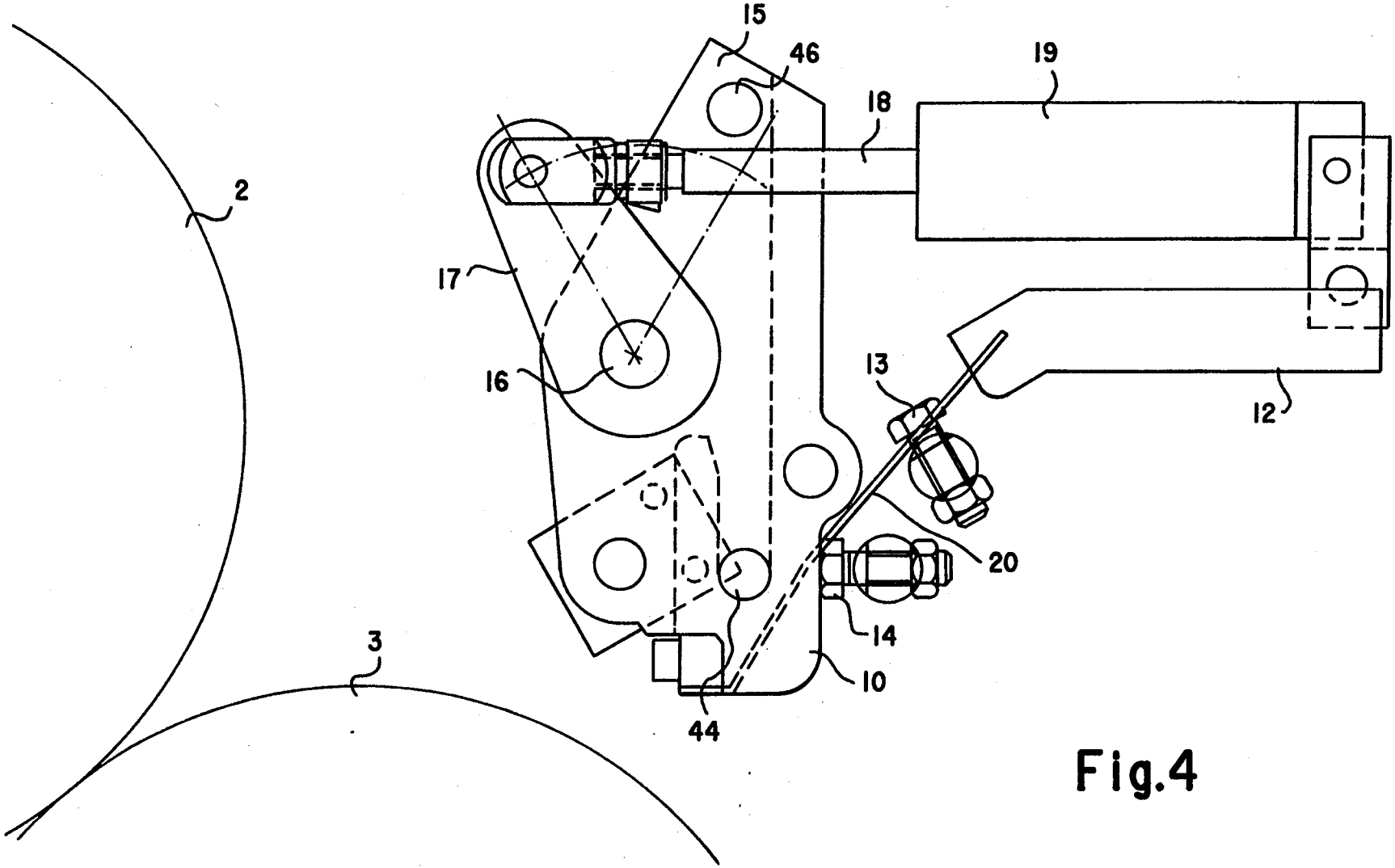
FIG. 4 is a view like that of FIG. 3 showing the pivot drive in another operating phase thereof, namely, in the position for washing the impression cylinder.
Figure 5:
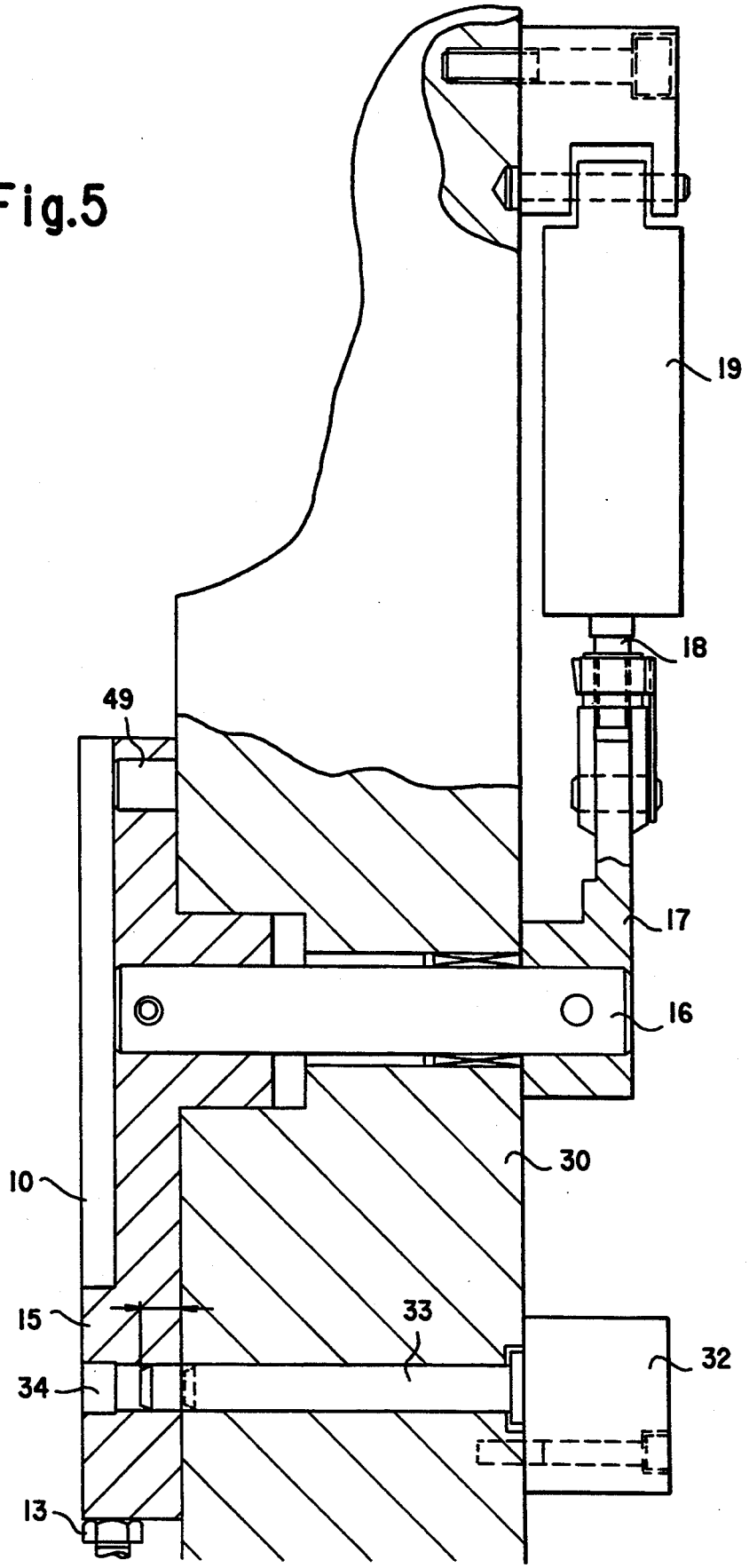
FIG. 5 is an enlarged top plan view, partly broken away and partly in section, of the pivot drive, as shown in FIG. 3.
Figure 6:
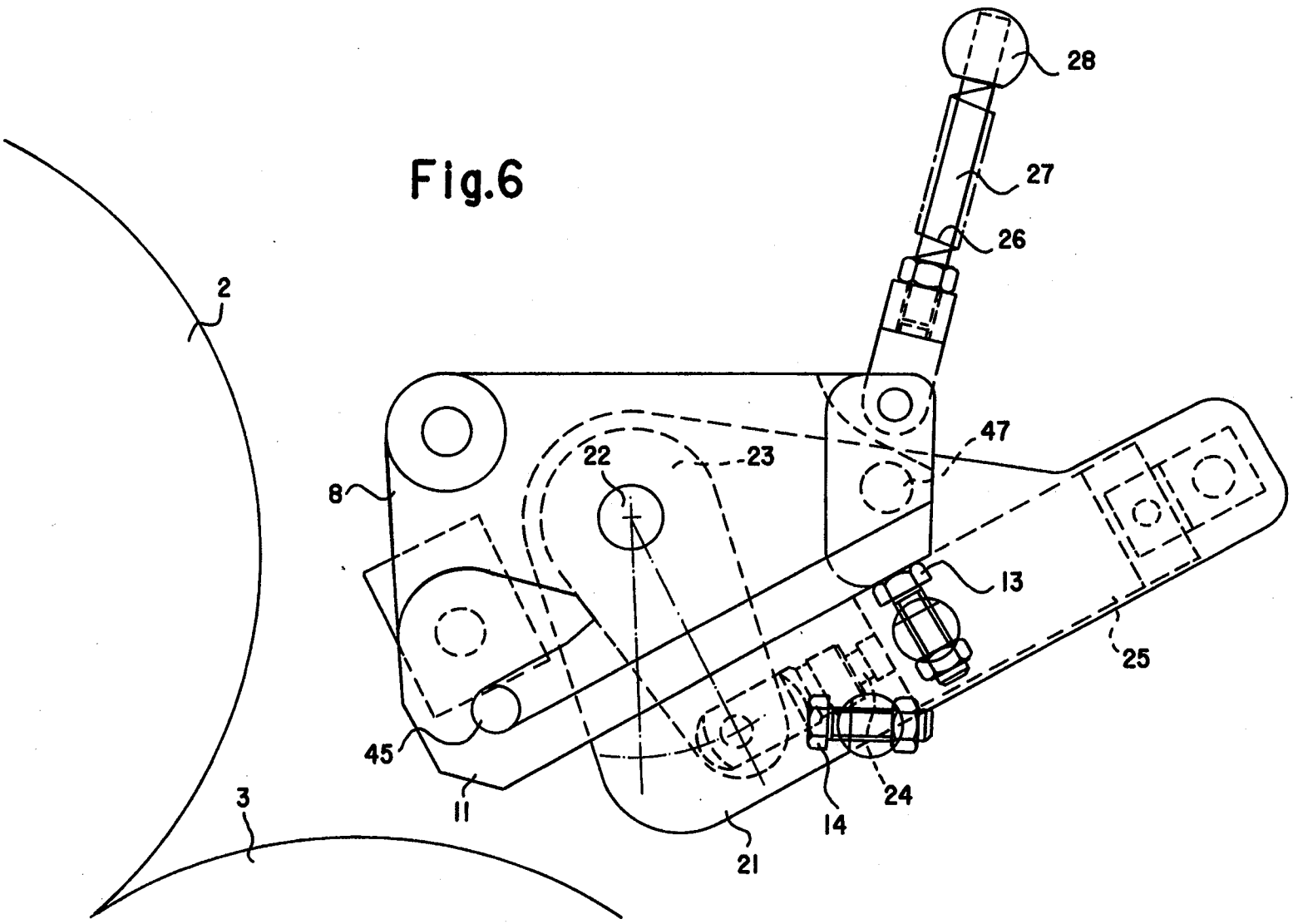
FIG. 6 is a side elevational view of a drive for feeding the cloth in the washing device shown in the position for washing the rubber blanket cylinder.
Figure 7:
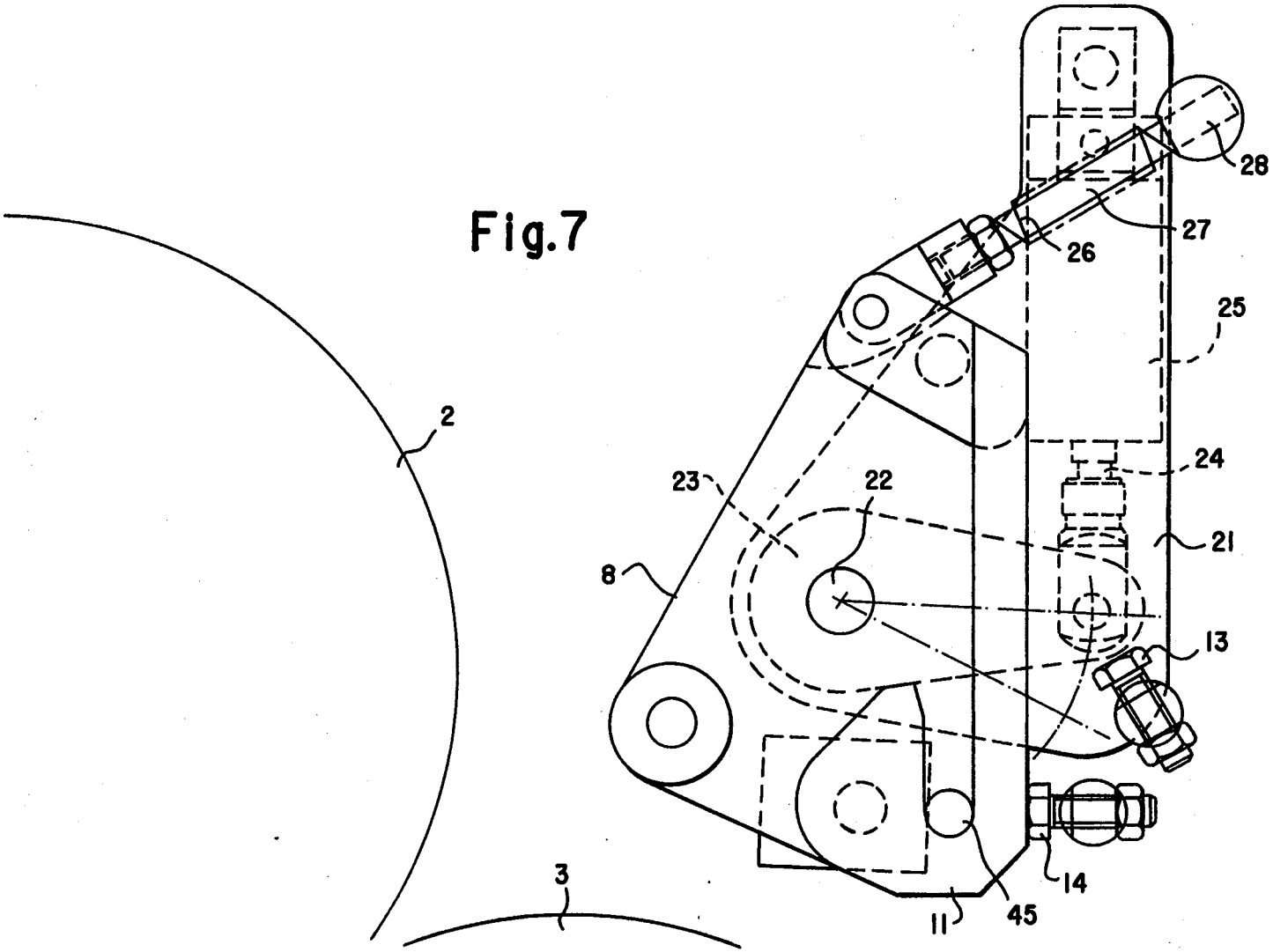
FIG. 7 is a view like that of FIG. 6 showing the cloth-feeding drive in another operating phase thereof, namely, in the position for washing the impression cylinder.

As is apparent from FIGS. 3 to 10, respective support plates 8 and 15 are mounted, in the right-hand and left-hand side frames 29 and 30 (FIGS. 8 and 5) of the press, as viewed in sheet-conveying direction, on pivot shafts 22 and 16, which are rotatably journalled in the side frames 29 and 30 of the press. The support plate 15 assigned to the left-hand side frame 30 of the press is fastened to the pivot shaft 16, as shown in FIG. 5. The pivot shaft 16 extends outwardly through the left-hand side frame 30 of the press. A lever 17 is fastened to the outwardly extending end of the pivot shaft 16. A piston rod 18 of a pneumatic cylinder 19 is articulatingly connected or linked at an end thereof to the other end of the lever 17. The pneumatic cylinder 19, in turn, is pivotally linked or articulatingly connected at the other end thereof to the side frame 30 of the press.

Figure 8:
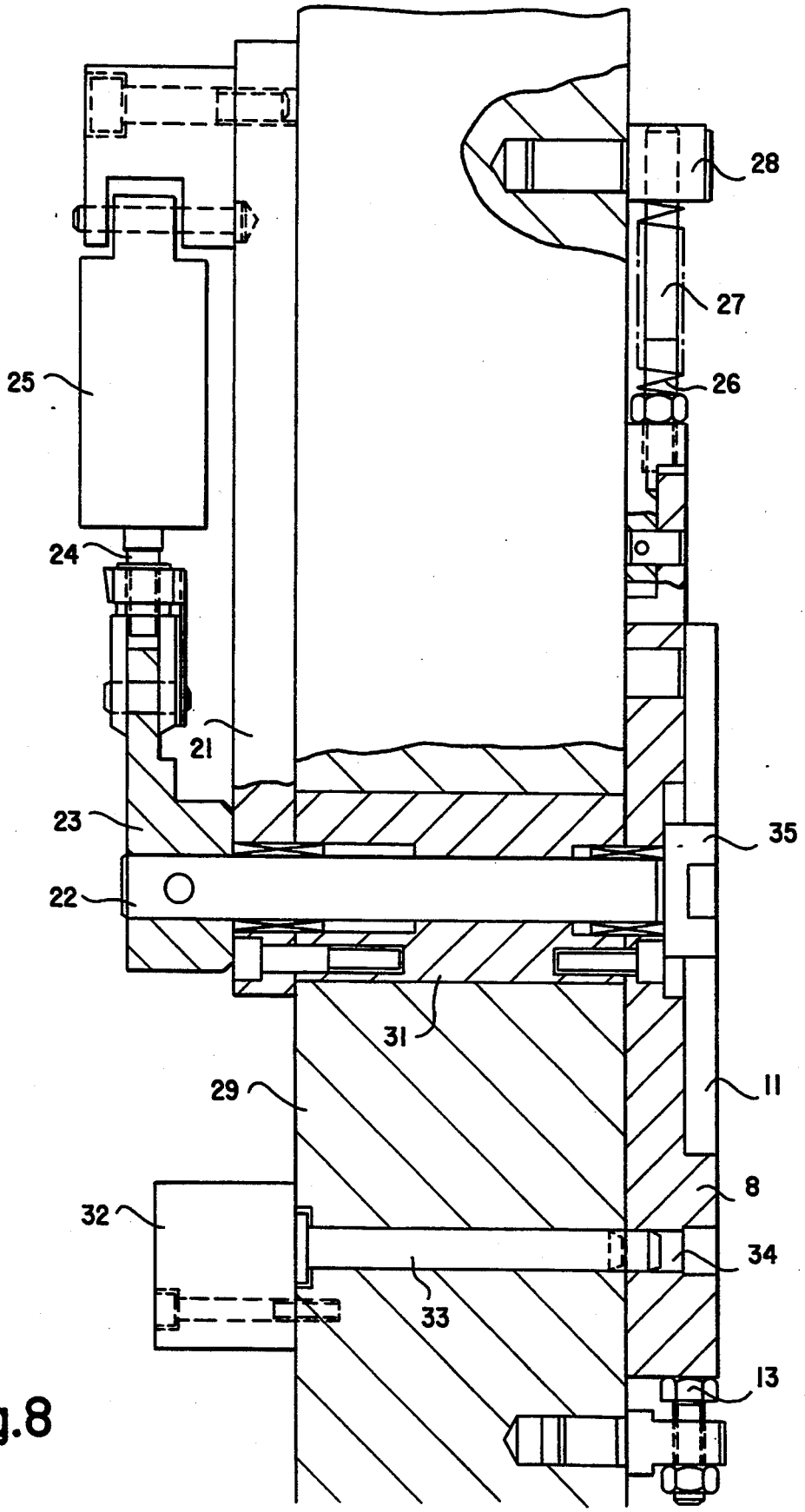
FIG. 8 is a top plan view of FIG. 6, partly broken away and partly in section, showing the cloth-feeding drive in greater detail.

The support plate 8 assigned to the right-hand side frame 29 of the press is rotatably mounted on the pivot shaft 22, as illustrated in FIG. 8. A support plate 21 is rotatably mounted on the pivot shaft 22 on an outward extension thereof through the side frame 29 of the press. A lever 23, which is fastened to the support plate 8 and rotatably mounted concentrically with the pivot shaft 22 in the side frame 29 of the press, is fastened by an end thereof to the further extension of the pivot shaft 22. A piston rod 24 of a pneumatic cylinder 25 is articulatingly connected or linked to the other end of the lever 23. The pneumatic cylinder 25 is pivotally linked or hinged to support plate 21.

Both of the support plates 8 and 15, on the respective sides thereof facing towards the washing device 1, are provided with guide rails 11 which are aligned parallel to one another. Two bearing bolts 45, 47 and 44, 46, respectively, are fastened to the two support plates 7 (only one of which is illustrated) of the washing device 1 on the sides thereof facing outwardly towards the side frames 29 and 30 of the press. The two bearing bolts 45 and 44 and the two bearing bolts 46 and 47, respectively, are aligned coaxially with one another. All of the bearing bolts 44 to 47 are constructed so that they serve to reliably guide the washing device 1 by engaging with the guide rails 10 and 11, respectively.

Figure 10:
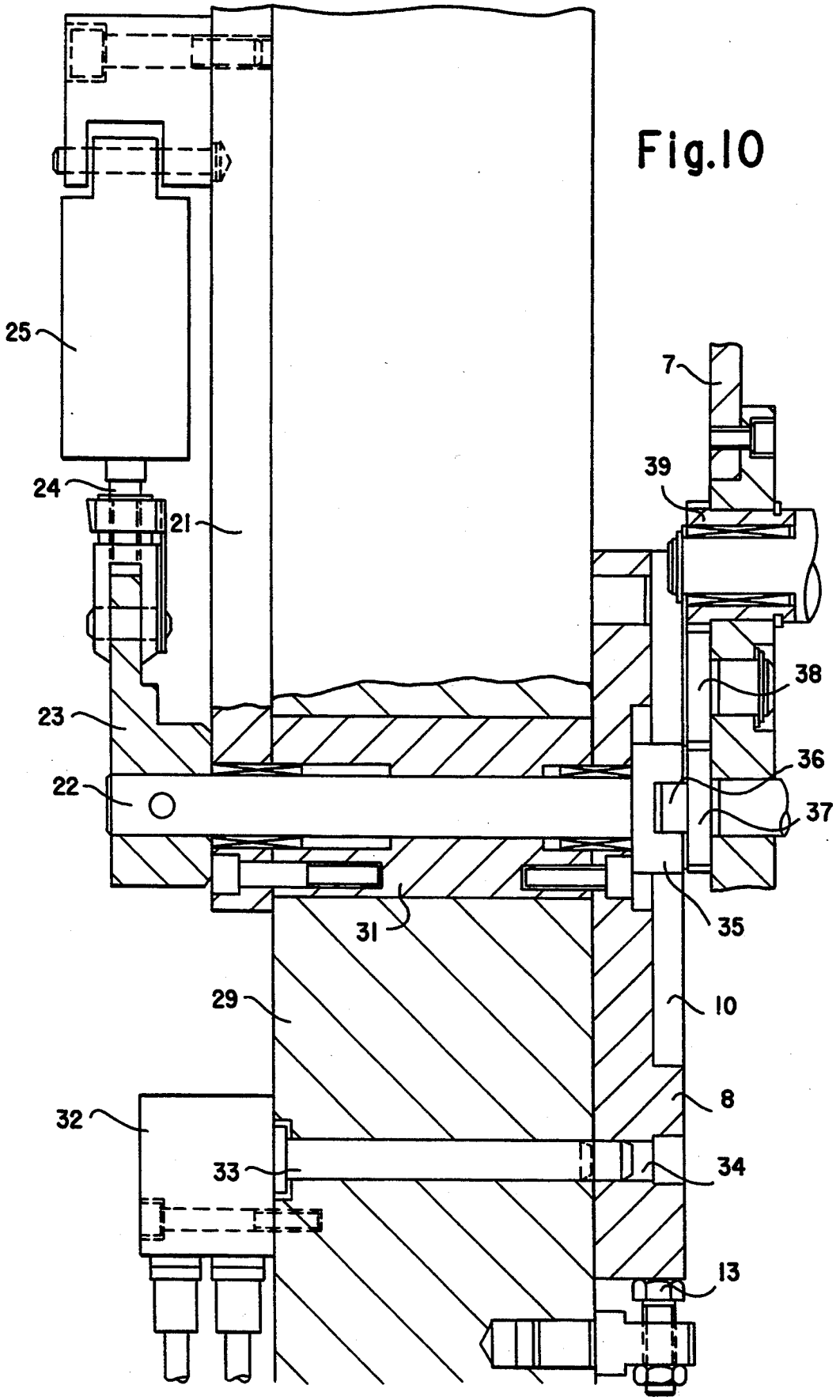
FIG. 10 is a view like that of FIG. 8 of the cloth-feeding drive as well as a sectional view of the connection therefor.

As shown in FIGS. 8 and 10, the pivot shaft 22 is formed as an entrainer or driver fork 35 in an end region thereof. An entrainer or driver 36 constructed so as to correspond to the entrainer or driver fork 35 is rotatably mounted in the support plate 7 of the washing device 1. A gear 37, which is in meshing engagement with an intermediate gear 38 rotatably mounted in the support plate 7, is connected to the entrainer or driver 36 so as to be fixed against rotation relative thereto. The gear 38 meshes with a gear 39 rotatably fastened on the shaft of the soiled-cloth winding roller 6 and is connected to the soiled cloth winding roller 6 via a free-wheeling clutch.

Arresting drives 32 fastened to the side frames 29 and 30 of the press can engage in arresting openings 34 formed in the respectively assigned support plates 7 and 8 with the aid of arresting pins 33 mounted in the side frames 29 and 30 of the press and axially displaced by the arresting drives 32. The support plates 7 and 8, respectively, can thus be arrested in both of the pivot positions thereof.

To assume the working position thereof, the washing device 1 is placed into service with the aid of the bearing bolts 44 to 47 via the guide 12 fastened to the housing and, in connection therewith, via the respective guide rails 10 and 11, which are set and locked in the pivot position thereof for cleaning the rubber blanket cylinder, until the respective bearing bolts 44 and 45 cooperate with a stop in the respective guide rails 10 and 11. The device 1 is arrestable in the support plates 7 and 8 by means of the bolts 46 and 47 which engage in bores 49.

After disabling or undoing the arresting of the device 1 by retracting the pins 33 with the help of the arresting drive 32, it is possible to pivot the pivot shaft 16 and, accordingly, the support plate 8 from the position thereof for washing the rubber blanket cylinder 2, as illustrated in FIG. 3, into the position thereof for washing the impression cylinder 3, as shown in FIG. 4. Pivot travel is limited by two stops 13 and 14 mounted in the side frames 29 and 30 of the press. While the support plate 8 is being pivoted, the washing device 1 which has been arrested with respect to the guide rails 10 and 11 is also pivoted via the non-illustrated support plate 7 and, likewise, the illustrated support plate 7, together with the support plate 8 and the support plate 21 fixedly connected to the latter and carrying the pneumatic cylinder 25 and the pivot shaft 22, are pivoted way via the washing device 1.

It is conceivable that the support plate 8, and the washing device 1 therewith, can be snapped regularly into the respectively pivoted-in working position with the aid of a compression spring 26 guided on a spring rod 27 and articulatingly connected or linked at one end thereof to the support plate 8 and braced at the other end thereof against a spring bearing 28 secured to the side frame 29 of the press, as shown in FIG. 8.

Figure 9:
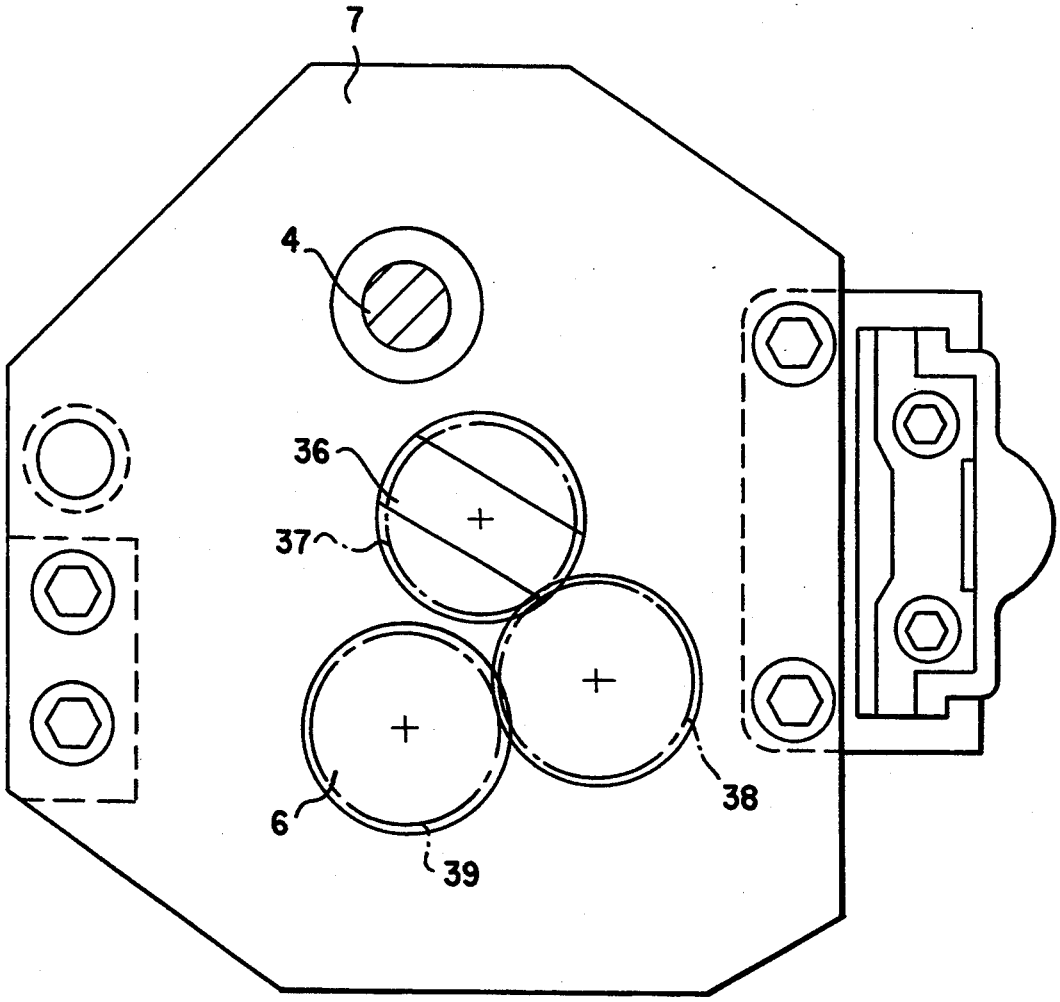
FIG. 9 is a side elevational view of a connection for the cloth-feeding drive.

As further shown in FIGS. 8 to 10, the driver or entrainer 36 and the gear 37 therewith are pivotable by the pivot shaft 22 and the driver or entrainer fork 35 with the aid of the pneumatic cylinder 25. The gear 39 is rotated via the gear 38, by means of which the soiled-cloth winding roller 6, which is fixed to the gear 39, is rotated therewith for further rolling up the cleaning cloth 5. The soiled-cloth winding roller 6 is movable in only one direction with the aid of a free-wheeling clutch to safeguard against any undesired release of the tension of the soiled cloth and against any unintentional backward transport of the soiled cloth.

As is illustrated in FIGS. 2 and 3, for providing reliable sheet guidance during sheet travel, a sheet guide plate 20 can be fastened to the washing device,1 so that, in the rest position of the washing device 1 which corresponds to the work position for cleaning the rubber blanket cylinder 2, the sheet guide plate 20, in a region above the impression cylinder 3, braces paper sheets from above, during the course of travel thereof and as they are being transported, with the aid of grippers, by the impression cylinder 3. Damage, to the paper sheets and to the washing device 1 due to fluttering action can thereby be avoided.

If the washing device 1 is to be removed from its position for the purpose of providing improved access to the rubber blanket cylinder 2 or the impression cylinder 3, it is retracted while in the work position thereof for cleaning the rubber blanket cylinder, after undoing or disabling the arresting effect by means of the bearing bolts 46 and 47 on the support plates 8 or 15 with respect to the guide rails 10 and 11 and after aligning the driver or entrainer fork 35 parallel to the guide rail 11 into a non-illustrated standby position along the guide rails 10, 11 and 12, or it is removed from the press, particularly also for changing the wash cloth.

The position of the fork opening is advantageously selected so that it is disposed parallel to the guide rail 11 in the starting position of the cloth feed. Following each cloth feed stroke or advance, the fork opening is returned to this parallel position by retracting the pneumatic cylinder piston into the starting position thereof. A free-wheeling clutch prevents the cloth from turning in backward direction.

As shown in FIG. 1, a cleaning-medium application device 48 of conventional construction is fixed in position upstream, as viewed in the direction of rotation of the rubber blanket cylinder 2, between the side frames 29 and 30 of the press in the vicinity of the rubber blanket cylinder 2 and above the washing device 1. The washing medium may be applied at any time in a conventional manner to the cleaning cloth from the outside in that washing position of the rubber blanket cylinder which is more often employed because of greater soiling.

Other crowned or domed embodiments 41*a* to 41*f* of the pressure diaphragm or membrane, as shown by way of example in FIGS. 11*b* to 11*g*, are conceivable. The crowned embodiments 41 and 41*a* to 41*f* permit rapid and exact bridging of the impression-cylinder grippers when the impression cylinder is cleaned, and also a complete cleaning of the impression cylinder in the regions thereof adjoining the impression-cylinder grippers.

I claim:

1. Device for selectively cleaning a plurality of cylinders of a sheet-fed printing press, comprising a washing device having means forming a cleaning surface, and mutual pressure means for selectively bringing said cleaning surface into contact with a selective one of the cylinders along a line of contact of said cleaning surface and the one cylinder extending parallel to a longitudinal axis of the one cylinder, and for selectively bringing said cleaning surface into contact with another of the cylinders along a line of contact of said cleaning surface on the other cylinder extending parallel to a longitudinal axis of the other cylinder, drive means for moving said cleaning surface so as to vary the position of said contact line with respect to said cleaning surface, a clean-cloth winding roller and a soiled-cloth winding roller, said cleaning cloth having one end thereof rolled onto said clean-cloth winding roller and the other end thereof rolled onto a soiled-cloth winding roller, common support means for supporting said clean-cloth and said soiled-cloth winding rollers and said mutual pressure means in common, and means for pivoting said common support means and guide means for receiving said common support means.

2. Device according to claim 1, wherein said contact line is common to said cleaning surface and to each of a plurality of the cylinders and is pivotable from cylinder to cylinder.

3. Device for selectively cleaning a plurality of cylinders of a sheet-fed printing press, comprising a washing device having means forming a cleaning surface, and pressure means for selectively bringing said cleaning surface into contact with a selective one of the cylinders along a line of contact of said cleaning surface and the one cylinder extending parallel to a longitudinal axis of the one cylinder, and for selectively bringing said cleaning surface into contact with another of the cylinders along a line of contact of said cleaning surface on the other cylinder extending parallel to a longitudinal axis of the other cylinder, and drive means for moving said cleaning surface so as to vary the position of said contact line with respect to said cleaning surface, wherein said means forming said cleaning surface comprise a cleaning cloth, and including a clean-cloth winding roller and a soiled-cloth winding roller, said cleaning cloth having one end thereof rolled onto said clean-cloth winding roller and the other end thereof rolled onto a soiled-cloth winding roller, common support means for supporting said clean-cloth and said soiled-cloth winding rollers and said mutual pressure means in common, guide means pivotally mounted in side frames of the printing press, said common support means being insertable into said guide means, and means provided on the side frame of the printing press for pivoting said guide means.

4. Device according to claim 1, wherein the printing press has side frames, and said drive means for moving said cleaning surface are provided in the side frames of the printing press.

5. Device according to claim 4, including means for moistening said cleaning cloth disposed in the side frames of the printing press in vicinity of the one cylinder.

6. Device according to claim 3, wherein said means for pivoting said guide means comprise a common shaft journalled in the side frames of the printing press for introducing a force for pivoting said pivotally mounted guide means as well as for activating said drive means for moving said cleaning surface.

7. Device according to claim 3, including common shaft means journalled in the side frames of the printing press for introducing a force and for simultaneously serving as a pivot shaft of the device.

8. Device according to claim 3, including means for arresting said washing device in a working position of the cleaning device wherein said guide means form an insert opening wherein said washing device is received, means for forming, in said working position, a driving connection between said drive means for moving said cleaning surface and said soiled-cloth winding roll, and means for disabling said arresting means for removing said washing device from said working position and simultaneously breaking said driving connection between said cleaning-surface drive means and said soiled-cloth winding roll.

9. Device according to claim 3, wherein one of the cylinders to be cleaned is a rubber blanket cylinder and another of the cylinders is an impression cylinder, and including a sheet guiding device disposed on said common support means in vicinity of the impression cylinder.

10. Device according to claim 1, wherein said drive means for moving said cleaning surface comprise means for feeding said cleaning cloth over said mutual pressure means from said clean-cloth winding roller to said soiled-cloth winding roller.

* * * * *